US007887358B2

(12) United States Patent
Dean

(10) Patent No.: US 7,887,358 B2
(45) Date of Patent: Feb. 15, 2011

(54) CONNECTOR CLAMP

(75) Inventor: David Dean, Litchfield Park, AZ (US)

(73) Assignee: Adtron Corporation, Phoenix, AZ (US)

( * ) Notice: Subject to any disclaimer, the term of this patent is extended or adjusted under 35 U.S.C. 154(b) by 16 days.

(21) Appl. No.: 12/183,006

(22) Filed: Jul. 30, 2008

(65) Prior Publication Data

US 2010/0009564 A1 Jan. 14, 2010

Related U.S. Application Data

(60) Provisional application No. 61/079,122, filed on Jul. 8, 2008.

(51) Int. Cl.
*H01R 4/28* (2006.01)

(52) U.S. Cl. ..... 439/345

(58) Field of Classification Search ..... 439/345, 439/346, 472, 449, 571, 373, 640
See application file for complete search history.

(56) References Cited

U.S. PATENT DOCUMENTS 4,448,474 A * 5/1984 Melnychenko ..... 439/472
5,348,495 A * 9/1994 Kasden ..... 439/371
5,980,298 A * 11/1999 Johnson ..... 439/359
7,140,907 B2 * 11/2006 Baldwin, Jr. ..... 439/449
2007/0183209 A1 * 8/2007 Ni et al. ..... 365/185.22
2008/0034173 A1 * 2/2008 Lavin ..... 711/159
2008/0089020 A1 * 4/2008 Hiew et al. ..... 361/684

* cited by examiner

*Primary Examiner*—Alexander Gilman
(74) *Attorney, Agent, or Firm*—Greenberg Traurig, LLP

(57) ABSTRACT

A connector clamp, for a hard drive having a first connector for mating with an external connector, having a top clamp and a bottom clamp. The top clamp includes a longitudinal section from which two arms extend, each arm including an integrally formed hole, and a bottom face, wherein a first gasket is attached to the bottom face and contacts the external connector when mated with the first connector. The bottom clamp includes an integrally formed first set of holes to receive a first set of screws for insertion into the hard drive, an integrally formed second set of holes to receive a second set of screws for insertion into the holes of the top clamp, and a top face, wherein a second gasket is attached to the top face and contacts the external connector when mated with the first connector.

20 Claims, 6 Drawing Sheets

200
211
230
230

211
213
212
219
214
217
216
226
226
215
602
604

602
604
216
230
230
218
210

300
310
316a
316b
316a
316b
654
652

310
654
652

652

316b
316b
316a
316a
312

CONNECTOR CLAMP

RELATED APPLICATIONS

This application claims priority to U.S. Provisional Patent Application Ser. No. 61/079,122, filed Jul. 8, 2008, which is incorporated herein by reference.

FIELD OF THE INVENTION

The present invention relates to storage devices and, in particular, hard drives receiving external cable connectors.

BACKGROUND

Over the past several years, storage devices utilizing solid state memory components have become popular replacements for rotating hard drives. Solid state memory components are especially advantageous in harsh environmental and industrial applications. Many of these storage devices incorporate Serial Advanced Technology Attachment (SATA) or Serial Attached SCSI (SAS) connector interfaces.

SATA is a computer bus primarily designed for transfer of data between a computer and mass storage devices, such as hard disk drives and optical drives. The main advantages over the older parallel ATA interface include faster data transfer, ability to remove or add devices while operating (hot swapping), thinner cables that let air cooling work more efficiently, and more reliable operation with tighter data integrity checks. SATA was designed as a successor to the Advanced Technology Attachment standard (ATA), and may eventually replace the older technology Parallel ATA or PATA. SATA adapters and devices communicate over a high-speed serial cable.

SAS is another data transfer technology designed to move data between a computer and computer storage devices, such as hard drives and tape drives. It is a point-to-point serial protocol that replaces the parallel SCSI bus technology that first appeared in the mid 1980s in corporate data centers. SAS uses the standard SCSI command set.

A SATA connector or a SAS connector mate with external connectors of computer cables, such as cables providing power and data from a computer. During engagement, pin contacts of the cable connectors slide over contact pads of the SATA/SAS connector. SATA/SAS connectors are quick to install, inexpensive, and relatively reliable for very low vibration applications.

However, in high vibration environments, the integrity of conventional engagements between SATA/SAS connectors and external cable connectors may be significantly degraded. For example, significant vibration may cause a cable connector over time to loosen and ultimately disengage from the SATA/SAS connector. In an environment with high vibration, pin contacts of the cable connectors also may rub or scrape against the contact pads of a SATA/SAS connector. This rubbing and scraping degrades physical contact between the SATA/SAS connector and the cable connectors, and undesirably may produce gold dust. Further, because physical contact is compromised, electrical communications between the hard drive and the computer, as well as the delivery of power, may be interrupted or altogether halted.

Perhaps worse still, use of conventional engagement techniques involving SATA/SAS connectors and cable connectors can break the SATA/SAS connector. In high vibration environments, SATA/SAS connectors are subjected to constant stresses and forces applied in all directions relative to the hard drive to which it is attached. Over time, the stresses and forces may cause the SATA/SAS connector to splinter from the hard drive.

SUMMARY OF THE INVENTION

An apparatus and method to secure cable connectors is described herein. Some embodiments are summarized in this section.

In one embodiment, the present invention includes a connector clamp including a top clamp; a bottom clamp configured to rigidly engage the top clamp, the top clamp and the bottom clamp, when engaged, forcibly securing coupling between an external connector and an internal connecter.

In another embodiment, the present invention includes a connector clamp for a hard drive having a SATA connector for coupling with external connectors, including a top clamp including longitudinal section from which two arms extend, each arm including an integrally formed hole, and a bottom face to which a first gasket is attached, the first gasket contacting the external connectors when coupled with the SATA connector; and a bottom clamp including an integrally formed first set of holes to receive a first set of screws for insertion into the hard drive, an integrally formed second set of holes to receive a second set of screws for insertion into the holes of the top clamp, and a top face to which a second gasket is attached, the second gasket contacting the external connectors when coupled with the SATA connector.

In yet another embodiment, the present invention includes a method for securing connectors, including attaching a top clamp to a hard drive having a first connector; mating a power connector and a communication connector to the first connector; attaching a bottom clamp to the hard drive; positioning the top clamp and the bottom clamp on opposite sides of the mated power connector, the communication connector, and the first connector; and creating, by the top clamp and the bottom clamp, a securing force on the mated power connector, the communication connector, and the first connector.

Other features and embodiments of the present invention will be apparent from the accompanying drawings and from the following detailed description.

BRIEF DESCRIPTION OF THE DRAWINGS

The embodiments are illustrated by way of example and not limitation in the figures of the accompanying drawings in which like references indicate similar elements.

DETAILED DESCRIPTION

The following description and drawings are illustrative and are not to be construed as limiting. Numerous specific details are described to provide a thorough understanding. However, in certain instances, well known or conventional details are not described in order to avoid obscuring the description. The invention may have numerous embodiments. References to one or an embodiment in the present disclosure are not necessarily references to the same embodiment.

Figure 1:
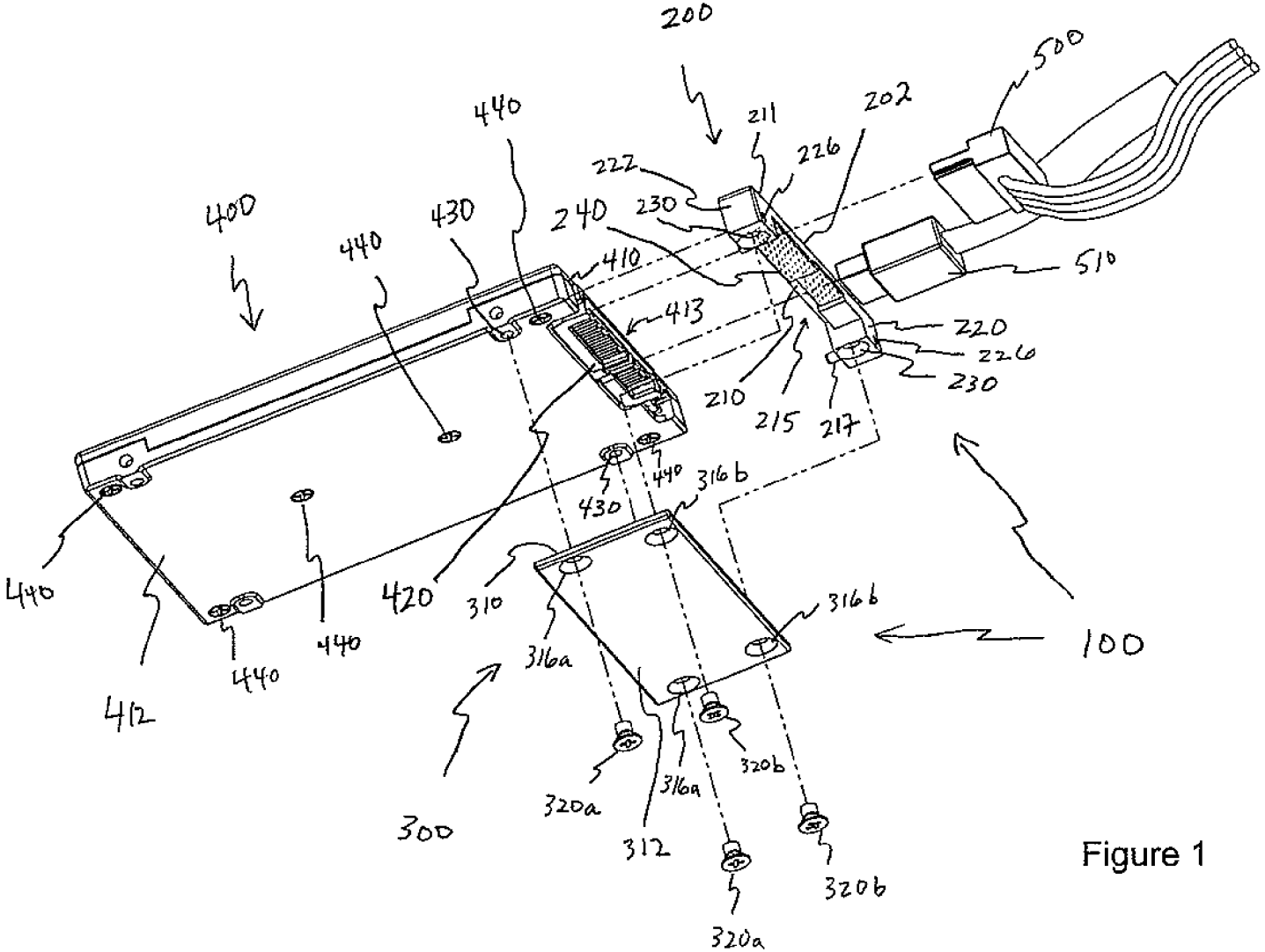
FIG. 1 is a perspective view of a preassembled connector clamp prior to engagement with a hard drive and cable connectors in accordance with the present invention.

FIG. 1 is a perspective view of a preassembled connector clamp 100 in accordance with the present invention. The connector clamp 100 includes a top clamp 200 and a bottom clamp 300. The top clamp 200 is formed of aluminum. In one embodiment, the top clamp 200 is formed of another material that is light and inexpensive. The top clamp 200 is substantially U-shaped, and includes a longitudinal section 202 terminating with opposite arms 220, 222. The arms 220, 222 extend substantially perpendicularly in the same direction from the longitudinal axis of the longitudinal section 202, creating a space 215. The top clamp 200 includes a bottom face 210 and an engaging face 240.

Figures 2A, 2B, 2C, 2D, 3A, 3B, 3C, 3D:
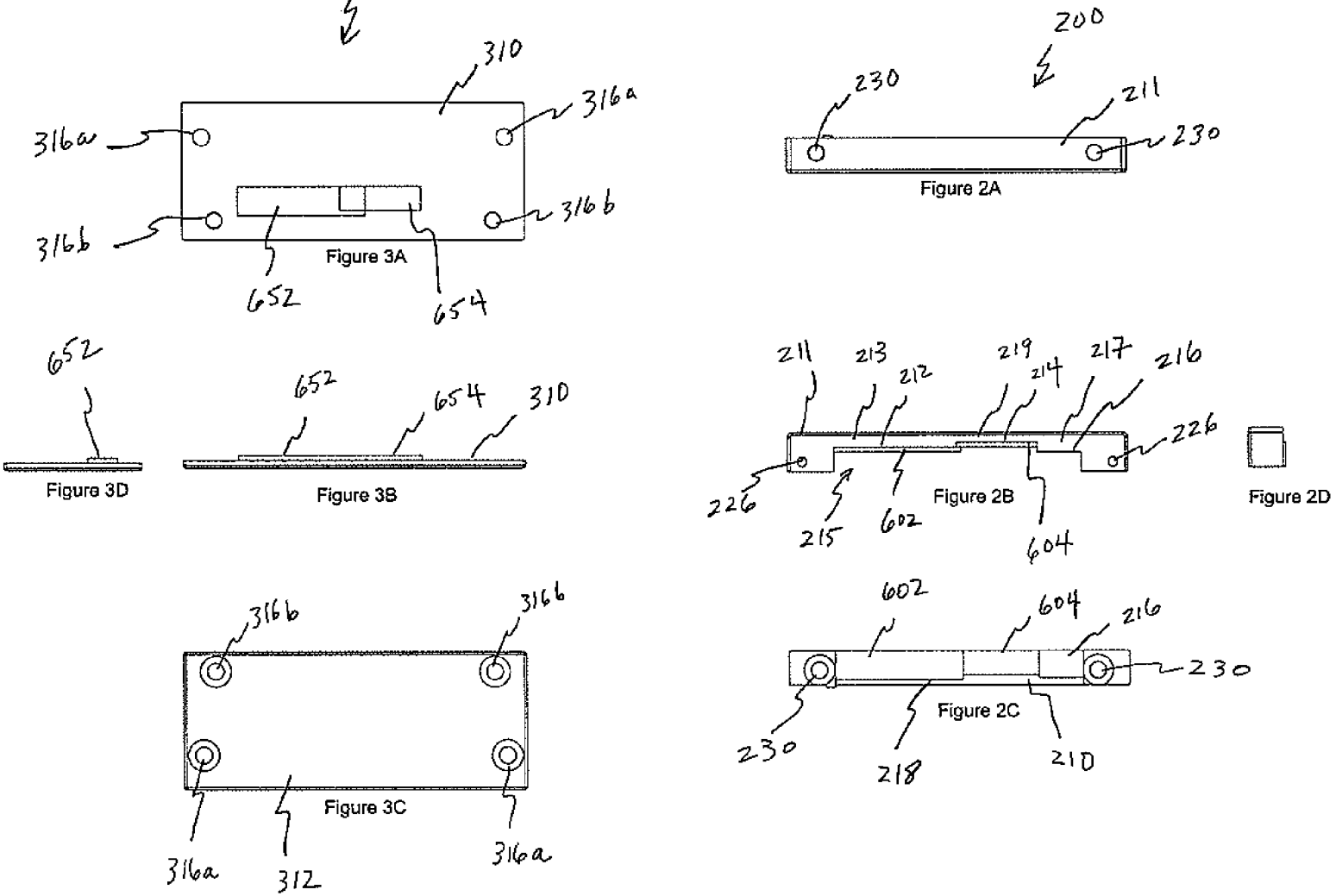
FIGS. 2A-2D are various views of a top clamp in accordance with the present invention.
FIGS. 3A-3D are various views of a bottom clamp in accordance with the present invention.

FIGS. 2A-2D are various views of the top clamp 200 in accordance with the present invention. FIG. 2A is a top view, FIG. 2B is a front view, FIG. 2C is a bottom view, and FIG. 2D is a side view of the top clamp 200. The space 215 adjacent the bottom face 210 of the top clamp 200 is formed by a first platform 213, a second platform 219, and a third platform 217 that each, respectively, define a first surface 212, a second surface 214, and a third surface 216. The first surface 212, the second surface 214, and the third surface 216 are substantially flat and rectangular. Each of the platforms extends an unequal distance in a direction perpendicular to the longitudinal axis of the top clamp 200 and away from a top face 211. An elongate strip 218 is formed along the bottom surface 210 in the absence of the first platform 213, the second platform 219, and the third platform 217. A first gasket 602 of the top clamp 200 is positioned to be in contact with the first surface 212. A second gasket 604 of the top clamp 200 is positioned to be in contact with the second surface 214. The first gasket 602 may extend to partially overlie the second gasket 604. The gaskets 602, 604 are dimensioned and located in a position on the bottom face 210 of the top clamp 200 so that when the top clamp 200 is engaged with a hard drive 400, the gaskets 602, 604 are in snug contact with a power connector 500 of a power cable 502 and a communication connector 510 of a communication cable 512 when mated with a SATA connector 420.

The gaskets 602, 604 are substantially rectangular, and formed of a vibration dampening foam. In one embodiment, the gaskets 602, 604 are formed of a resilient, flexible material. The gaskets 602, 604 provide clamping friction, as described in more detail below, and are a barrier to undesirable moisture, vapor, and dust. In one embodiment, the gaskets 602, 604 may be substituted for a single gasket to be positioned in contact with the first surface 212 and the second surface 214.

Holes 230 are integrally formed through the arms 220, 222 to receive screws. The holes 230 extend through the arms 220, 222 substantially in the same direction of the extension of the arms 220, 222. Holes 226 are integrally formed through the arms 220, 222 in a direction substantially perpendicular to the longitudinal axis of the longitudinal section 202 and substantially perpendicular to the direction of the holes 230. The holes 226 receive dow pins 217 that each ultimately bore into a terminal end of an engaging face 410 of the hard drive 400 adjacent each side of a space 413. The dow pins 217 allow the top clamp 200 to securely attach to the hard drive 400. In one embodiment, the top clamp 200 does not include holes 226 and dow pins 217 are not used with the top clamp 200.

FIGS. 3A-3D are various views of the bottom clamp 300 in accordance with the present invention. FIG. 3A is a top view, FIG. 3B is a front view, FIG. 3C is a bottom view, and FIG. 3D is a side view of the bottom clamp 300. The bottom clamp 300 is substantially planar, and includes a bottom face 312 and a top face 310. The bottom face 312 and the top face 310 are substantially flat. A first gasket 652 and a second gasket 654 of the bottom clamp 300 are positioned to be in contact with the top face 310 of the bottom clamp 300. The first gasket 652 and the second gasket 654 may extend to partially overlie one another. The gaskets 652, 654 are substantially rectangular, and formed of a vibration dampening foam. In one embodiment, the gaskets 652, 654 are formed of a resilient, flexible material. The gaskets 652, 654 are dimensioned and located on the top face 310 in a position so that, when the bottom clamp 300 is attached with the hard drive 400, the gaskets 652, 654 are in snug contact with the power connector 500 and the communication connector 510 when mated with the SATA connector 420. In one embodiment, the gaskets 652, 654 may be substituted for a single gasket to be positioned in contact with the top face 310.

Four holes 316 are integrally formed through the bottom clamp 300 in a direction substantially perpendicular to the planar surface of the bottom face 312 to receive screws 320. When the top clamp 200 and the bottom clamp 300 are engaged with the hard drive 400, the holes 316*a* are positioned to align with the holes 430 and the holes 316*b* are positioned to align with the holes 230. The bottom clamp 300 is formed of stainless steel. In one embodiment, the bottom clamp 300 is formed of another material that is rigid and durable.

As shown in FIG. 1, the connector clamp 100 provides secure attachment of the power connector 500 and the communication connector 510 to the hard drive 400. The hard drive 400 is a conventional 2.5 inch solid state drive. In one embodiment, the hard drive 400 may be a standard hard disk drive. In another embodiment, the hard drive 400 may be replaced by another storage device or any electronic component that is not a standard hard drive or standard solid state drive. The hard drive 400 includes an engaging face 410 and a bottom face 412. Upon assembly of the connector clamp 100, the engaging face 410 of the hard drive 400 and the engaging face 240 of the top clamp 200 are aligned and pressed together. At one end of the hard drive 400, the engaging face 410 and the bottom face 412 expose the space 413 in which the SATA connector 420 resides. The SATA connector 420 is described in the specification SATA Revision 2.6, Feb. 15, 2007.

The SATA connector 420 matingly engages with the power connector 500 and the communication connector 510. In one embodiment, an SAS connector can be used instead of or in addition to a SATA connector. In yet another embodiment, another type of connector besides a SATA connector or SAS connector can be used. In one embodiment, cable connectors other than a power connector and a communication connector can be used. The hard drive 400 has holes 430 to receive the screws 320*a*. Screws 440 on the bottom face 412 are part of the conventional assembly of the hard drive 400.

Figure 4:
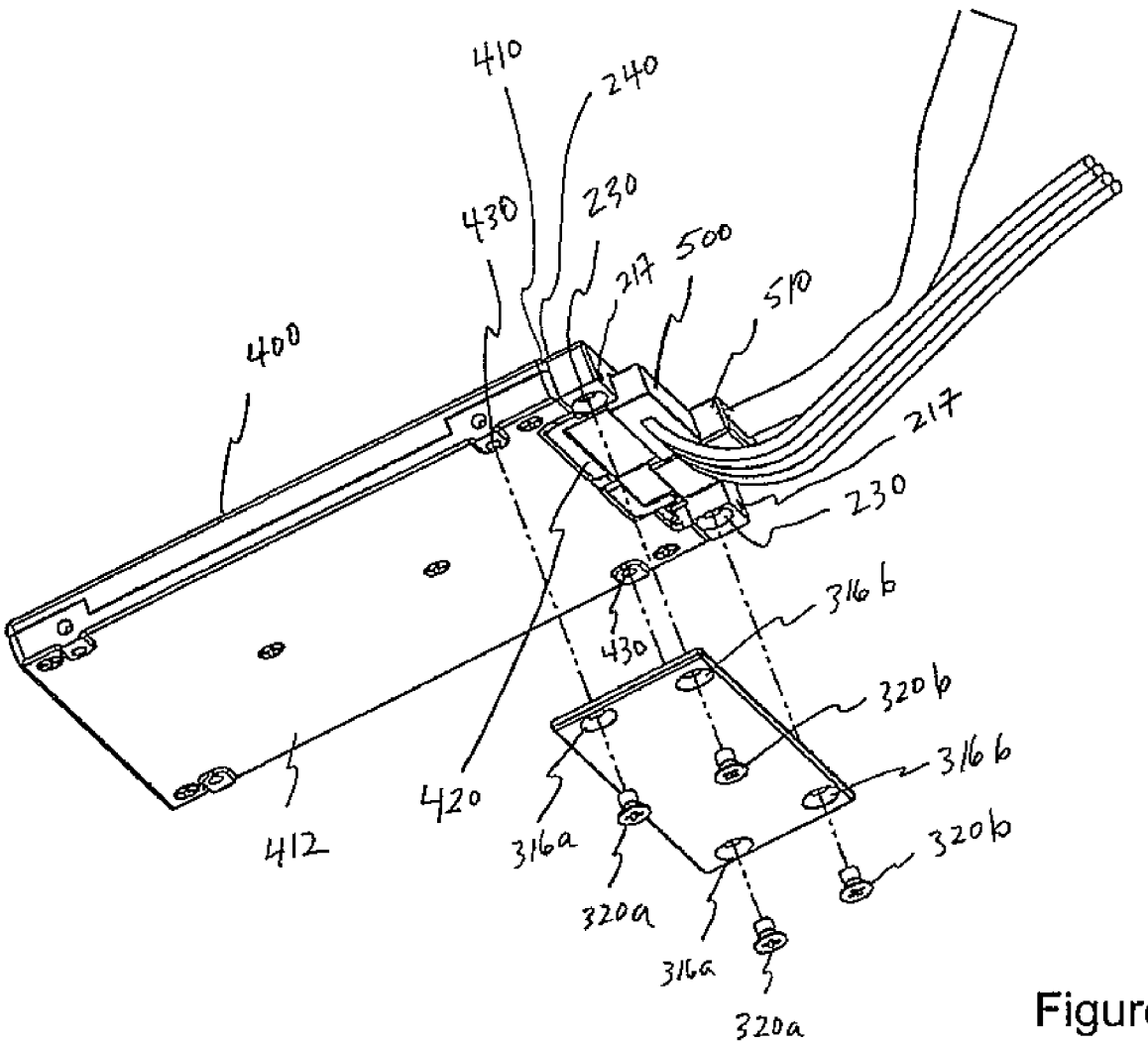
FIG. 4 is a perspective view of a partially assembled connector clamp in partial engagement with a hard drive and cable connectors in accordance with the present invention.

FIG. 4 is a perspective view of the partially assembled connector clamp 100 in partial engagement with the hard drive 400 and the power connector 500 and the communication connector 510. The engaging face 240 of the top clamp 200 is aligned and makes contact with the engaging face 410 of the hard drive 400. The power connector 500 and the communication connector 510 are inserted into the SATA connector 420 in the space 413. The power connector 500 and the communication connector 510 fit snugly into the space 215 by contacting the first gasket 602 and the second gasket 604.

The bottom clamp 300 is positioned to underlie and engage the contacting surface of the bottom face 412 and the space 413. The bottom clamp 300 is securely attached to the hard drive 400 by the screws 320*a* which are inserted into the holes 316*a* of the bottom clamp 300 and the holes 430 of the hard drive 400. The top clamp 200 is securely attached to the bottom clamp 300 by the screws 320*b* which are inserted into the holes 316*b* of the bottom clamp 300 and the holes 230 of the top clamp 200. The dow pins 217 are driven through the holes 226 to substantially perpendicularly extend into respective ends of the engaging face 410 of the hard drive 400. The dow pins 217 provide optional, additional support in securely affixing the connector clamp 100 to the hard drive 400.

Figure 5:
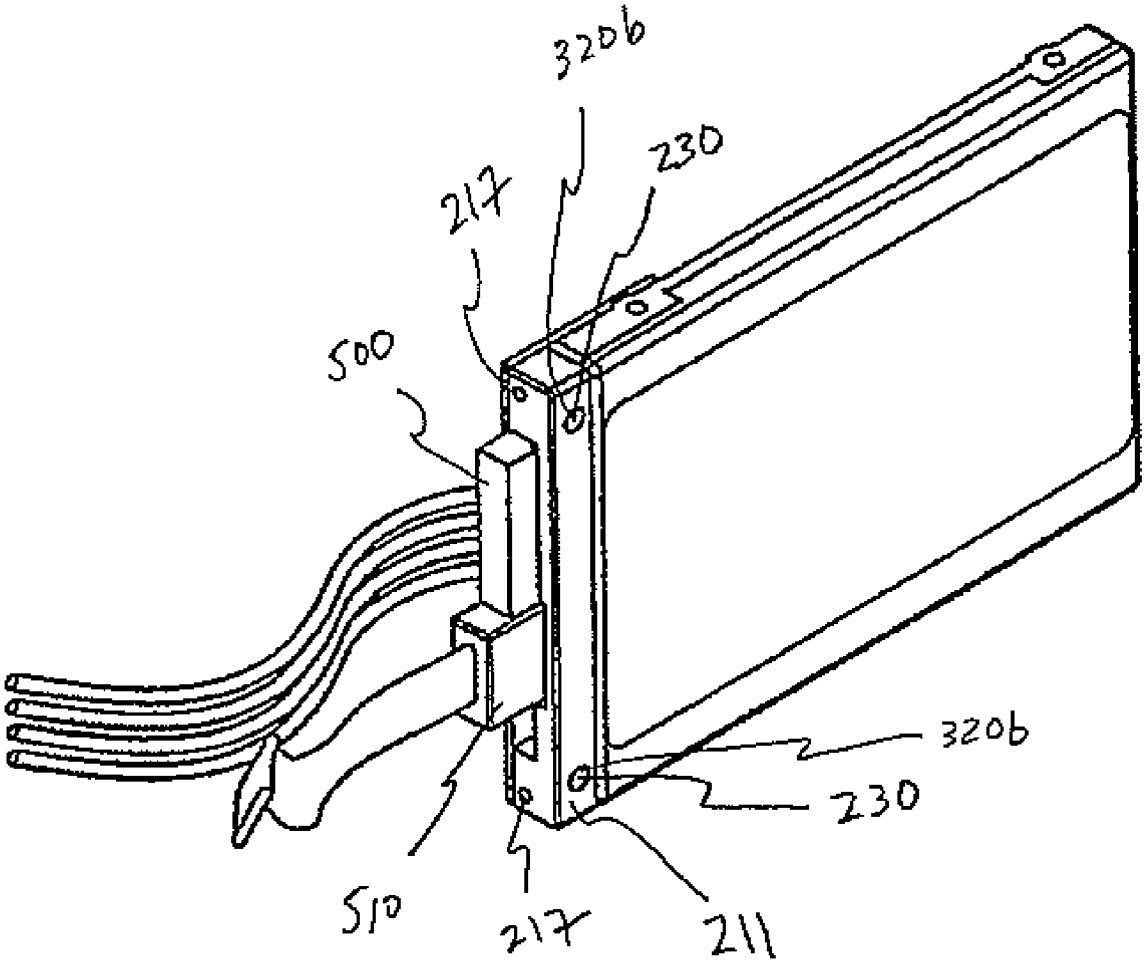
FIG. 5 is a perspective view of an assembled connector clamp in engagement with a hard drive and cable connectors in accordance with the present invention.

FIG. 5 is a perspective view of the assembled connector clamp 100 in engagement with the hard drive 400 and the power connector 500 and the communication connector 510 in accordance with the present invention. The screws 320*b* extend through the holes 316*b* of the bottom clamp 300 and the holes 230 of the top clamp 200 to securely attach the top clamp 200 to the bottom clamp 300. The dow pins 217 are inserted through holes 226 and into ends of the engaging face 410 of the hard drive 400.

Figure 6:
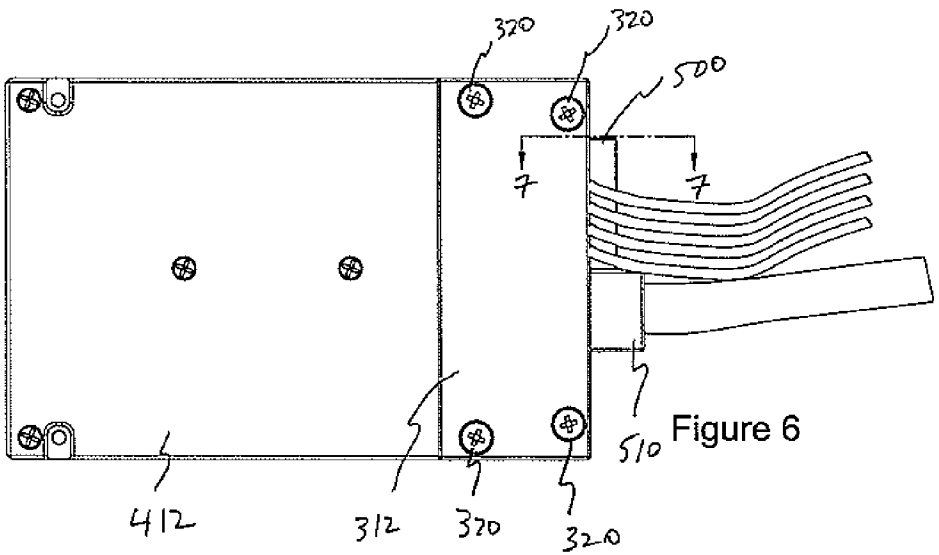
FIG. 6 is a bottom view of an assembled connector clamp in engagement with a hard drive and cable connectors in accordance with the present invention.

FIG. 6 is a bottom view of the assembled connector clamp 100 in engagement with the hard drive 400 and the power connector 500 and the communication connector 510 in accordance with the present invention. The screws 320 are driven into the holes 430 and the holes 230 in an upward direction from the bottom face 312 of the bottom clamp 300 to the hard drive 400 and the top clamp 200.

Figure 7:
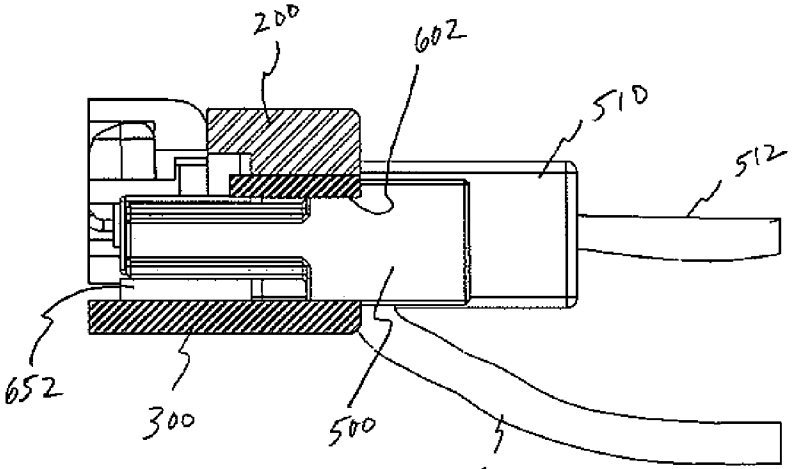
FIG. 7 is a cross-sectional view taken along line 7-7 of FIG. 6, showing a connector clamp engaged with the hard drive and cable connectors in accordance with the present invention.

FIG. 7 is a cross-sectional view taken along line 7-7 of FIG. 6, showing the connector clamp 100 engaged with the hard drive 400 and the power connector 500 and the communication connector 510 in accordance with the present invention. The top clamp 200 and the bottom clamp 300 clamp together the mated SATA connector 420 and the power connector 500 and the communication connector 510. In particular, the first gasket 602 of the top clamp 200 is securely pressed against an upper surface of the power connector 500. The first gasket 652 of the bottom clamp 300 is securely pressed against a lower surface of the power connector 500. The second gasket 604 of the top clamp 200 and the second gasket 654 of the bottom clamp 300 likewise are securely pressed against, respectively, the upper and lower surfaces of the communication connector 510. The screws 320*b* are adjustable to determine the desired clamping force.

By using compressive force and friction, the connector clamp 100 increases contact force on the mated SATA connector 420 and the power connector 500 and the communication connector 510. The present invention thus securely restrains the mated connectors in three dimensions. In accordance with the present invention, the secured mated connectors can be released only upon deliberate mechanical manipulation of the connector clamp 100.

Figure 8:
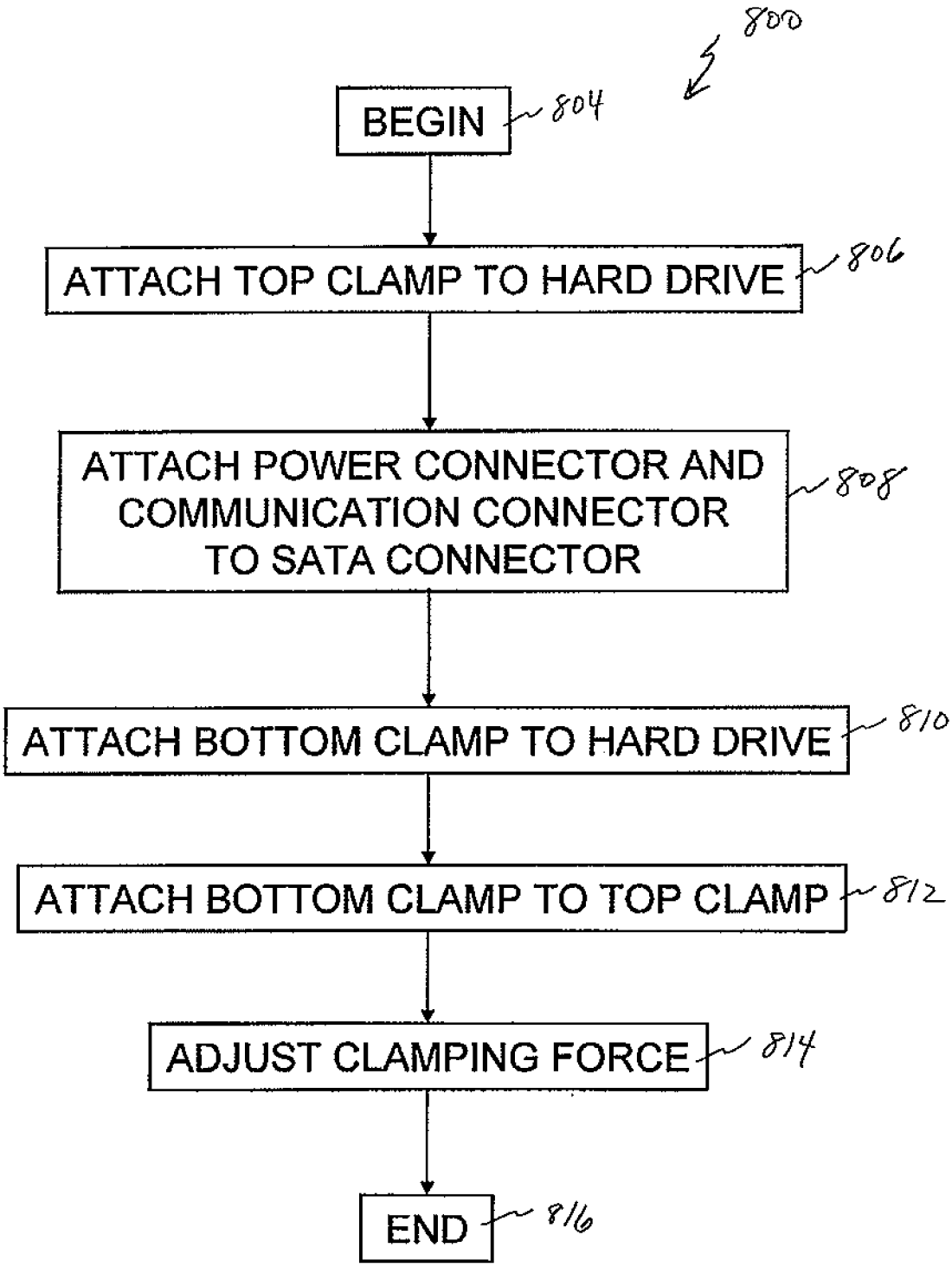
FIG. 8 is a flow chart involving a connector clamp in accordance with the present invention.

FIG. 8 is a flow chart of an exemplary method 800 involving the connector clamp 100 in accordance with the present invention. The method 800 begins at block 804 and proceeds to block 806. At block 806, the top clamp 200 is attached to the hard drive 400, and the method 800 proceeds to block 808. At block 808, the power connector 500 and the communication connector 510 are attached to the SATA connector 420, and the method 800 proceeds to block 810. At block 810, the bottom clamp 300 is attached to the hard drive 400, and the method 800 proceeds to block 812. At block 812, the bottom clamp 300 is attached to the top clamp 200, and the method 800 proceeds to block 814. At block 814, clamping force produced by the bottom clamp and the top clamp 200 is adjusted, and the method proceeds to block 816. At block 816, the method 800 ends.

The connector clamp 100 in accordance with the present invention adds strength and reliability to conventional connector designs by securely attaching a mated pair of connectors to a hard drive housing. The present invention extends the usable lifetime of contacts in a mated pair of connectors in high shock or high vibration environments because the contacts are prevented from continuously scrubbing against one another. The resulting elimination of relative movement between the contacts enhances contact-to-contact stability to provide consistent and constant signal integrity. In addition, the present invention provides a barrier to prevent the undesirable accumulation of moisture, vapor, and dust in the connectors, also enhancing contact-to-contact stability and thus signal integrity.

The present invention provides a low cost and low profile solution by innovatively rigidly and securely tying a mated pair of connectors to a storage device enclosure. The present invention obviates a need to extend the mated connector length and allows a generally available off-the-shelf connector to be converted for use in extreme conditions of vibration and shock. Further, the present invention involves the addition of a relatively insignificant amount of weight to a hard drive. The connector clamp 100 of the present invention can be simply installed using conventional mounting techniques.

In the foregoing specification, the disclosure has been described with reference to specific exemplary embodiments thereof. It will be evident that various modifications may be made thereto without departing from the broader spirit and scope as set forth in the following claims. The specification and drawings are, accordingly, to be regarded in an illustrative sense rather than a restrictive sense.

Further, it is to be understood that even though numerous characteristics and advantages of the present invention have been set forth in the foregoing description, together with details of the structure and function of the invention, the disclosure is illustrative only, and changes may be made in detail, especially in matters of shape, size, number, and arrangement of parts within the principles of the invention to the full extent indicated by the broad general meaning of the terms in which the appended claims are expressed.

The present invention is adapted to carry out the objects and attain the advantages mentioned, as well as others inherent therein. While the present invention has been depicted, described, and is defined by reference to exemplary embodiments of the invention, such references do not imply a limitation on the invention, and no such limitation is to be inferred.

The present invention is capable of considerable modification, alternation, and equivalents in form and function, as will occur to those ordinarily skilled in the pertinent art and having the benefit of this disclosure. The depicted and described embodiments of the invention are exemplary only, and are not exhaustive of the scope of the present invention. Consequently, the present invention is intended to be limited only by the spirit and scope of the appended claims, giving full cognizance to equivalents in all respects.

What is claimed is:

1. A connector clamp comprising:

a top clamp; and a bottom clamp configured to rigidly engage the top clamp, the top clamp and the bottom clamp, when engaged, forcibly securing coupling between an external connector and an internal connecter in three dimensions without gaps and covering all surfaces of the internal connector.

2. The connector clamp of claim 1 wherein at least one resilient flexible material is attached to a surface of the top clamp that faces the external connector and the internal connector when coupled, the resilient flexible material for contacting a surface of at least one of the external connector and the internal connector.

3. The connector clamp of claim 1 wherein at least one resilient flexible material is attached to a surface of the bottom clamp that faces the external connector and the internal connector when coupled, the resilient flexible material for contacting a surface of at least one of the external connector and the internal connector.

4. The connector clamp of claim 2 wherein the resilient flexible material includes a vibration dampening foam that serves as a gasket for the top clamp.

5. The connector clamp of claim 3 wherein the resilient flexible material includes a vibration dampening foam that serves as a gasket for the bottom clamp.

6. The connector clamp of claim 1 wherein the top clamp includes:

a longitudinal section from which two opposite arms extend in a similar direction to define a space, each arm including an integrally formed hole, and a bottom face, adjacent to the space, to which a gasket is attached, the gasket contacting at least one of the external connector and the internal connector when coupled.

7. The connector clamp of claim 1 wherein the bottom clamp includes:

an integrally formed set of holes to receive a set of screws for insertion into the top clamp, and a top face to which a gasket is attached, the gasket contacting at least one of the external connector and the internal connector when coupled.

8. The connector clamp of claim 1 wherein the top clamp includes:

a longitudinal section from which two arms extend, each arm including an integrally formed hole, and a bottom face to which a first gasket is attached, the first gasket contacting at least one of the external connector and the internal connector when coupled; and the bottom clamp includes:

an integrally formed first set of holes to receive a first set of screws for insertion into the holes of the top clamp, and a top face to which a second gasket is attached, the second gasket contacting at least one of the external connector and the internal connector when coupled.

9. The connector clamp of claim 8 wherein the bottom clamp includes an integrally formed second set of holes to receive a second set of screws for attachment to a hard drive.

10. The connector clamp of claim 8 wherein the first set of screws adjustably secure the external connector and the internal connector when coupled.

11. The connector clamp of claim 1 wherein the internal connector is a SATA connector.

12. The connector clamp of claim 1 wherein the internal connector is an SAS connector.

13. The connector claim of claim 1 wherein the external connector includes a communication connector for a communication cable.

14. The connector of claim 1 wherein the external connector includes a power connector for a power cable.

15. A connector clamp for a hard drive having a SATA connector for coupling with external connectors, comprising:

a top clamp including:

a longitudinal section from which two arms extend, each arm including an integrally formed hole, and a bottom face to which a first gasket is attached, the first gasket contacting the external connectors when securely coupled with the SATA connector in three dimensions without gaps and covering all surfaces of the SATA connector; and a bottom clamp including:

an integrally formed first set of holes to receive a first set of screws for insertion into the hard drive, an integrally formed second set of holes to receive a second set of screws for insertion into the holes of the top clamp, and a top face to which a second gasket is attached, the second gasket contacting the external connectors when securely coupled with the SATA connector in three dimensions without gaps and covering all surfaces of the SATA connector.

16. The connector clamp of claim 15 wherein the first gasket and the second gasket are each formed of a single continuous piece of vibration dampening material.

17. The connector clamp of claim 15 wherein the top clamp includes pin holes for receiving pins to engage the hard drive, the pins securing the top clamp with the hard drive.

18. A method for securing connectors, comprising:

attaching a top clamp to a hard drive having a first connector and covering all surfaces of the first connector;

mating a power connector and a communication connector to the first connector;

attaching a bottom clamp to the hard drive;

positioning the top clamp and the bottom clamp on opposite sides of the mated power connector, the communication connector, and the first connector; and creating, by the top clamp and the bottom clamp, a securing force on the mated power connector, the communication connector, and the first connector in three dimensions without gaps.

19. The method of claim 18 further comprising:

positioning a first gasket between the bottom clamp and the mated power connector, the communication connector, and the first connector; and positioning a second gasket between the top clamp and the mated power connector, the communication connector, and the first connector.

20. The method of claim 18 further comprising:

connecting the top clamp and the bottom clamp with screws; and adjusting the screws to vary the securing force.

* * * * *